US008413290B1

(12) United States Patent
Taverne

(10) Patent No.: US 8,413,290 B1
(45) Date of Patent: Apr. 9, 2013

(54) TROWEL WITH REMOVABLE TEXTURE SKIN

(76) Inventor: Thomas Taverne, Vernon, NY (US)

( * ) Notice: Subject to any disclaimer, the term of this patent is extended or adjusted under 35 U.S.C. 154(b) by 257 days.

(21) Appl. No.: 12/932,393

(22) Filed: Feb. 25, 2011

(51) Int. Cl.

| | |
|---|---|
| ***E04F 21/16*** | (2006.01) |
| ***E04G 21/20*** | (2006.01) |
| ***B05C 17/10*** | (2006.01) |
| ***B05C 21/00*** | (2006.01) |

(52) U.S. Cl.
USPC ..... 15/235.4; 15/245.1; 15/246; 425/182; 425/385; 425/458

(58) Field of Classification Search ..... 15/104.001, 15/235.4–235.8, 245.1, 246; 404/89, 93, 404/118; 425/182, 383, 458, 385; D8/45
See application file for complete search history.

(56) References Cited

U.S. PATENT DOCUMENTS

| | | | | |
|---|---|---|---|---|
| 2,190,811 | A * | 2/1940 | Van Zeeland | 15/235.4 |
| 2,952,028 | A * | 9/1960 | Robbins | 15/235.4 |
| 4,131,406 | A | 12/1978 | Fresquez | |
| 4,135,840 | A | 1/1979 | Puccini | |
| 4,209,865 | A * | 7/1980 | Kozlowski | 7/105 |
| 4,231,677 | A | 11/1980 | Roming | |
| 4,776,723 | A | 10/1988 | Brimo | |
| 4,828,426 | A | 5/1989 | Hendricks | |
| 4,838,728 | A | 6/1989 | McKeever | |
| 4,993,867 | A | 2/1991 | Usow | |

OTHER PUBLICATIONS

Brickform tool from website, 360 S. Lilac Ave , Rialto, CA 92376.
Proline Concrete Tools from website, 2564 Jason Court, Oceanside, CA 92057.
Urethane Products by: US , Mountville, Pa 17554.
Concrete Supply House, No physical address available www.concretesupplyhouse.com/concrete-sstamps/stamping-tools/tampers-stampers/, "Rubber Coated Hand Tamper Tool".
Contractor Source, No physical address available. WWW.walttools.com True Texture Trowel.

* cited by examiner

*Primary Examiner* — Mark Spisich

(57) ABSTRACT

One embodiment of a thin, flat texture skin for attachment to the blade of a trowel and of the type having at one edge a slot (3) which communicates with a gripping aperture (4). The opening has a notch (5) to allow handle support attached to inserted blade to pass beyond the edge of the tool. The corners (6) of the bottom (8) and edges (9) are rounded and tapered toward the top (7). The bottom (8) and edges (9) are imparted a texture transferable to surfaces. Other embodiments are described as shown.

1 Claim, 1 Drawing Sheet

TROWEL WITH REMOVABLE TEXTURE SKIN

BACKGROUND

Prior Art

Figure 1:
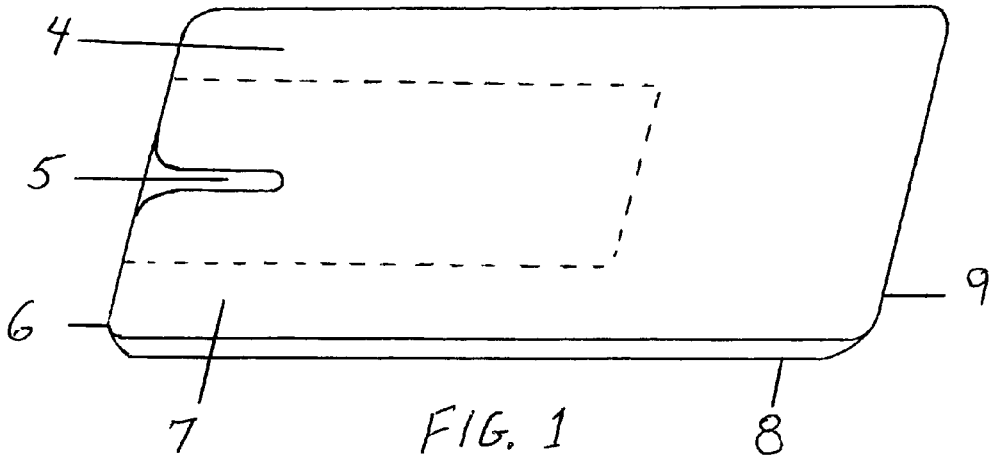

The following is a tabulation of some prior art that presently appears relevant:

U.S. Patents

| Pat. No. | Kind Code | Publ. Date | Patentee |
|---|---|---|---|
| 5,766,728 | B1 | Jan. 16, 1998 | Iwaya |

Nonpatent Literature Documents www.brickform.com/textureMats.asp, "Flexible Texture Mats"

www.prolinestamps.com, "Billy Banger Hand Tamper"

www.ebay.com, Item number 380160575983, "Old Brick-Single Brick Touch Up Concrete Stamp Mat"

www.concretesupplyhouse.com/concrete-sstamps/stamping-tools/tampers——stampers/, "Rubber Coated Hand Tamper Tool"

www.ebay.com, Item number 380104456734, "Tru Texture Trowel for Vertical Concrete-Lite"

Manufacturers of tools for the decorative concrete industry supply items called texture skins or mats with the terms used interchangeably. These are tools made of rubber or plastic and are thin and flexible. They have a special texture on one side that transfers to the surface of plastic concrete during a process called "stamping". The thin texture skins have been made in many shapes and sizes.

All the texture skins heretofore known suffer from a number of disadvantages:

(a) The flexible texture skins are used in a way where both hands are required. One hand is placed on each side while the mat is flexed in the shape of a taco shell and dabbed onto the concrete surface. This is a common way to touch up imperfections on a wet, newly stamped concrete. Great care must be taken to not dig the skins edges into the concrete during this critical phase of the stamping process. The resulting dig marks will become apparent in the surface when the project is complete.

(b) The handless texture skins can be used by holding it up in one hand next to a vertical concrete surface and striking the back of the tool with the open hand to transfer the texture to the concrete surface. The texture skin tool with strap or D-ring handle requires a similar striking action. Injuries are a concern whenever the hand is used as a striking tool.

(c) Texturing a stair tread is difficult with the floppy texture skin tool. When reaching under the overhanging formwork, the floppy texture skin will accidentally sag down and touch the concrete surface before it can be placed over the area that needs to be textured. This limited ability to cantilever forward creates scuffs or drag marks that are visible once the concrete is sealed.

(d) There is no duck bill style tool currently available.

(e) Strap handle, D-handle and no-handle design texture skins require a separate striking tool such as a rubber mallet or hand tamper to avoid hand pounding or to comfortably increase the force beyond what is achievable with the operator's hand.

(f) Previous designs have a shorter reach capability under obstacles like formwork and railings caused by the handle hitting the obstacle or a sagging texture skin.

(g) Previous designs result in an obstructed view of the work being done by both the tool and the hand(s).

(h) Non-handled texture skins need to be placed on the ground in order to perform other work tasks.

(i) Strap and D-handled mats require another piece of equipment such as a belt hook to make the tool more accessible.

(j) The economy of purchasing and organizing the multiple items makes them complex.

(k) The intended use is only for texturing stamped concrete.

SUMMARY

In accordance with one embodiment a cantilever texture skin hand tool comprises a thin body having an offset handle device.

ADVANTAGES

Accordingly several advantages of one or more aspects are as follows: to provide a texture skin that is operable with one hand, that is used for fine detail work, that provides superior maneuverability, that increases the safety of operation, that operates more comfortably, that is easier to operate, that increases operators reach, that is economical, that increases the rate of production, that reduces surface imperfections, that is operable on any inclination, that can be used in a stabbing motion, that works under overhanging obstructions, that can be used in a hammering type swing, that is attachable to a margin trowel, that can have various handles, that reduces the number of tools required to do the job, that is easy to carry, that can be used to texture a wide variety of materials, etc.

DRAWINGS

Figures

Figure 2:
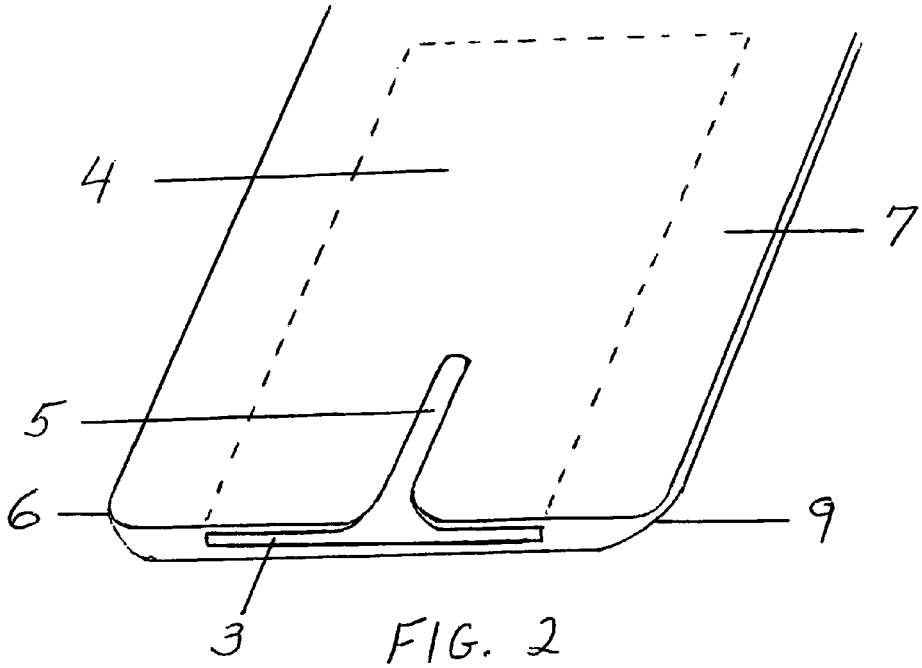

FIGS. 1 and 2 show various aspects of a texture skin supplied with slot and lead in notch in accordance with one embodiment.

DRAWINGS

Reference Numerals

| | |
|---|---|
| 3 | slot |
| 4 | gripping aperture |
| 5 | lead in notch |
| 6 | corner |
| 7 | top |
| 8 | bottom |
| 9 | edge |

DETAILED DESCRIPTION

FIG. 1 and FIG. 2—First Embodiment

One embodiment of the texture skin is illustrated in FIG. 1 AND FIG. 2. The texture skin consists of a flexible material capable of being repeatedly flexed without breaking. This embodiment is made of pourable mold rubber. However, a texture skin can be manufactured with other means and consist of any other material that can be repeatedly bent without fracturing, such as polyethylene, polypropylene, vinyl, nylon, rubber, leather, various impregnated or laminated fibrous materials, various plasticized materials, cardboard, paper, etc.

The overall dimensions roughly 85 cm×19 cm×13 cm thickness. The outer four corners 6 of the tool are rounded and sloped so they do not produce a pattern of crisp line indents in the finished product. An interior slot 3 formed by pouring the mold rubber around a metal tongue which is later removed is the gripping aperture 4 that attaches to a trowel blade. Slot 3 dimensions roughly 5 cm×12.5 cm×1-2 cm. The lead in notch 5 is formed so it allows the stem of the trowel that connects its blade to its handle, to pass beyond the edge 9 of the tool. The forward reach dimension from the tip of the tool to its handle stem notch 5 is roughly 14 cm.

OPERATION

FIG. 1 and FIG. 2—First Embodiment

The manor of using the texture skin hand tool is similar to that of texture skin in present use. To prepare for use, first hold a common 2 in margin trowel that possesses an offset handle in one hand and the removable texture skin in the other hand. Insert the blade of the margin trowel into slot 3 and push it in until it hits the back of the slot or the notch 5 contacts the handle stem and stops. You are ready to work.

Alternative Embodiments

In essence a margin trowel is a hand held device attached at an offset angle(s) to a blade. Another form is the shape of a kitchen pancake turner. There are various styles of handles with offset blades attachable to a texture skin. Including, gauging trowel, tucking tool, brick trowel, etc. A margin trowel is preferred for its availability, shape, and size.

There are various possible methods to attach a margin trowel like blade to a texture skin body including, adhesive, encapsulation, rivets, wire, screws, etc. Removability is chosen over permanent bonding. Including lower cost of production that is transferable to the end user, decreased tool storage space requirements and flexibility to use a wide variety of other tools as a handle.

There are an infinite number of possible shapes for the edges and body of the texture skin including straight, rounded, curved, long, short, or any combination of shape and size.

Various styles, length and angles of handles can be used to create a trowel with removable texture skin that would resemble the kitchen turner style tool to meet specific design or utility requirements.

ADVANTAGES

From the description above, a number of advantages of some embodiments of my trowel with removable texture skin hand tool become evident:

(a) Manufacture of the tool as a slide on attachment for an existing tool will be less costly than providing the texture skin permanently bonded to its handled device.

(b) The ability to cantilever the texture skin is substantially increased.

(c) Straight edges on the trowel with removable texture skin are useful because of the predominance of straight lines found in modern construction.

(d) The insertion of a margin trowel type tool provides a very thin, stable platform for the softer skin material. The blade is the skeleton giving strength to the top and bottom more pliable layers of skin. Forming a steel reinforced rubber sandwich.

(e) The user can use the tool in a stabbing motion to texture the joint between opposing surfaces of inside corners.

(f) The operator can use the tool in a hammer like manner as more pressure is needed because of hardening concrete.

(g) The tool operator can perform the texturing operation from a distance limited only by the length of the handle.

(h) Controlled downward pressure can be applied to the trowel with removable texture skin. Much like pushing a hamburger down on a grill to make it flatter.

(i) The user can carry the tool in a back pocket out of the way with the handle end down.

(j) The operator can use the tool to texture many types of surface finishes.

Accordingly, the reader will see that the trowel with removable texture skin hand tool of various embodiments can be used to texture concrete easily and conveniently, can be used with handles of various length and shape, and can produce better quality finishes, and is economical. In addition, when fitted with the handle, the texture skin can be used as a texturing hammer and so can increase jobsite safety by reducing worker hand injuries and fatigue. Furthermore, the trowel with removable texture skin hand tool has the additional advantages in that:

It permits increased speed in texturing;

It permits increased quality of texturing;

It permits decreased occurrence of mistakes caused by dropping edges of other known tools on finish able surfaces;

It permits the texture skin to be held and in a cantilevered position;

It permits a better view of the work being produced with the hand(s) out of the way;

It permits multiple use of the handle when removed;

It increases work place safety; and

It increases work efficiency.

Although the description above contains much specificity, these should not be construed as limiting the scope of the embodiments but merely providing illustrations of some of the several embodiments. For example, the lead in notch can have other shapes such as circular, oval, trapezoidal, triangular, etc.; the slot can have other shapes or be nonexistent; the gripping aperture can be replaced with a swivel, adhesive, rivets, weldment, bolt, etc.; the shape and size of the texture skin can be changed to be made bigger, smaller, thinner, rounded, hollow, longer or shorter; the texture skin rigidity can be achieved from various materials such as metal, plastic, wood, fiberglass and be located internally or externally; the texture of the skin can be changed to coarse, smooth or similar to any surface available in nature such as natural stone, brick, etc; the material of the texture skin can be of any various flexible material such as plastic, sponge, fiber, cloth etc; the handle can be made of various types of material; the handle can incorporate various grip styles and shapes; The handle can be swivel able or permanently bonded to the skin; the handle can have attachment options such as swiveled, threaded, bolt, clip, etc to receive an extension, etc.

Thus the scope of the embodiments should be determined by the appended claims and their legal equivalents, rather than by the examples given.

I claim:

1. A removable texture skin for use with a hand trowel comprising a blade with an offset handle, the texture skin comprising:

(a) an elongate substantially planar flexible body having opposed ends and a peripheral side edge;

(b) an entry slot extending into the body from one of the ends thereof and defining a receiving aperture extending from an open end at the one end of the body to a closed end spaced from the second end of the body;

(c) an access notch extending from a top surface of the body to the receiving aperture from the open end toward the closed end thereof, the access notch having a length shorter than that of the receiving aperture; and (d) wherein the blade of the trowel is adapted to be inserted into the entry slot and the receiving aperture until the end of the access notch engages the offset handle, and further wherein the portion of the body between the end of the receiving aperture and the second end of the body is configured to cantilever from both ends of the trowel blade.

* * * * *